US006224453B1

(12) United States Patent
McKinley, Jr. et al.

(10) Patent No.: US 6,224,453 B1
(45) Date of Patent: May 1, 2001

(54) MODULAR BUILDING BLOCKS WITH COLOR CODING

(75) Inventors: Roger B. McKinley, Jr.; Caron McKinley, both of Pleasanton, CA (US)

(73) Assignee: R/C Products, Pleasanton, CA (US)

( * ) Notice: Subject to any disclaimer, the term of this patent is extended or adjusted under 35 U.S.C. 154(b) by 0 days.

(21) Appl. No.: 09/326,490

(22) Filed: Jun. 4, 1999

(51) Int. Cl.[7] ..... A63H 33/20; A63H 33/04; A63H 33/06

(52) U.S. Cl. ..... 446/69; 446/117; 446/118

(58) Field of Search ..... 446/69, 85, 117, 446/118, 124, 125, 471, 489; 52/DIG. 10; 273/153 P; 206/499; 434/259

(56) References Cited

U.S. PATENT DOCUMENTS

| | | | | |
|---|---|---|---|---|
| 1,565,901 | * | 12/1925 | Brandt | 273/153 P |
| 2,981,009 | * | 4/1961 | Lindquist | 446/117 X |
| 3,159,403 | * | 12/1964 | Glass et al. | 446/117 X |
| 3,708,910 | * | 1/1973 | Skillman | 446/117 X |
| 4,121,831 | * | 10/1978 | Greene | 446/124 X |
| 4,437,668 | * | 3/1984 | Simpson et al. | 446/118 X |
| 4,604,073 | * | 8/1986 | Livesey et al. | 446/117 |
| 4,950,912 | * | 8/1990 | Goldfarb et al. | 446/117 X |
| 5,407,201 | * | 4/1995 | Whitehurst | 237/153 P X |
| 5,695,312 | * | 12/1997 | Kelly | 206/499 X |
| 5,762,529 | * | 6/1998 | Nizza | 446/85 |

* cited by examiner

*Primary Examiner*—D. Neal Muir
(74) *Attorney, Agent, or Firm*—The Kline Law Firm

(57) ABSTRACT

A color coded set of building blocks including a plurality of nesting blocks with diamond cross sections and at least one octahedron cap block. The blocks in each set are progressively sized so that when the individual blocks are stacked, they nest within each other to form a four-sided pyramid. The largest of the diamond cross section blocks acts as the base of the pyramid while the top of the pyramid is capped with an octahedron cap block. The blocks are stored in a clear pedestal base. The pedestal is also utilized as a design platform from which to build complex geometric designs. Each pedestal has four flared legs that provide stability to the platform while designs are constructed vertically and horizontally within it. By using linking elements, the designs can also be used to join together a plurality of the pedestal bases.

34 Claims, 7 Drawing Sheets

MODULAR BUILDING BLOCKS WITH COLOR CODING

FIELD OF THE INVENTION

The present invention relates generally to building block toys, and more particularly is a set of nested modular building blocks that are color coded to enhance their educational and entertainment utility.

BACKGROUND OF THE INVENTION

An age old pastime for children is playing with building blocks. Building blocks are packaged and distributed in an amazingly diverse array of types and collections. The type of building block offered is generally a function of what skill sets the children using the blocks are to be taught.

Historically, blocks were just that, blocks of wood. The blocks were typically formed from lumber scraps, and they were provided in a limited variety of geometric shapes. Over time, and with the evolution of injection molding, blocks have evolved into significantly more elaborate sets of building materials, many of them formed from plastic. The blocks are typically constructed with some form of pin/receiving hole connecting elements to fasten the blocks together. The connecting elements are formed integral to the blocks themselves.

One drawback to the current art building blocks with fastening means is that there is no efficient method of storing the blocks in a minimal volume without using the connecting elements. This requires the users to disassemble the blocks, sometimes requiring no small amount of effort, before the blocks can be used for play.

Accordingly, it is an object of the present invention to provide a set of blocks that are connected chiefly by friction means.

It is a further object of the present invention to provide a set of blocks that nests together for easy and efficient storage.

It is a still further object of the present invention to provide a set of blocks that is color coded.

SUMMARY OF THE INVENTION

The present invention is a color coded set of building blocks comprising a plurality of nesting blocks with diamond cross sections and at least one octahedron cap block. The blocks in each set are progressively sized so that when the individual blocks are stacked, they nest within each other to form a four-sided pyramid. The largest of the diamond cross section blocks acts as the base of the pyramid while the top of the pyramid is capped with an octahedron cap block.

The blocks are stored in a clear pedestal base designed to accept an inverted pyramid. A first set of blocks is stored in the base in inverted configuration. A second set of blocks can then be stacked on top of the first set in upright configuration so that the end result is an octahedron assembly with its base secured in the pedestal. In the preferred embodiment, the interior of the assembly is also filled so that a solid geometric shape is formed. While the preferred embodiment utilizes diamond cross section blocks to construct an octahedral assembly, it should be recognized that other geometric shapes could be utilized.

The pedestal is also utilized as a design platform from which to build complex geometric designs. Each pedestal has four flared legs that provide stability to the platform while designs are constructed vertically and horizontally within it. By using linking elements, the designs can also be used to join together a plurality of the pedestal bases.

An advantage of the present invention is that the blocks can be held together in various conformations without the need for pin/receiving hole joinder mechanisms.

Another advantage of the present invention is that the blocks nest together without locking so that they can be stored in minimal space and are easily taken apart.

A still further advantage of the present invention is that the color coding of the blocks aids in the building of pattern recognition skills for the children using the blocks.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
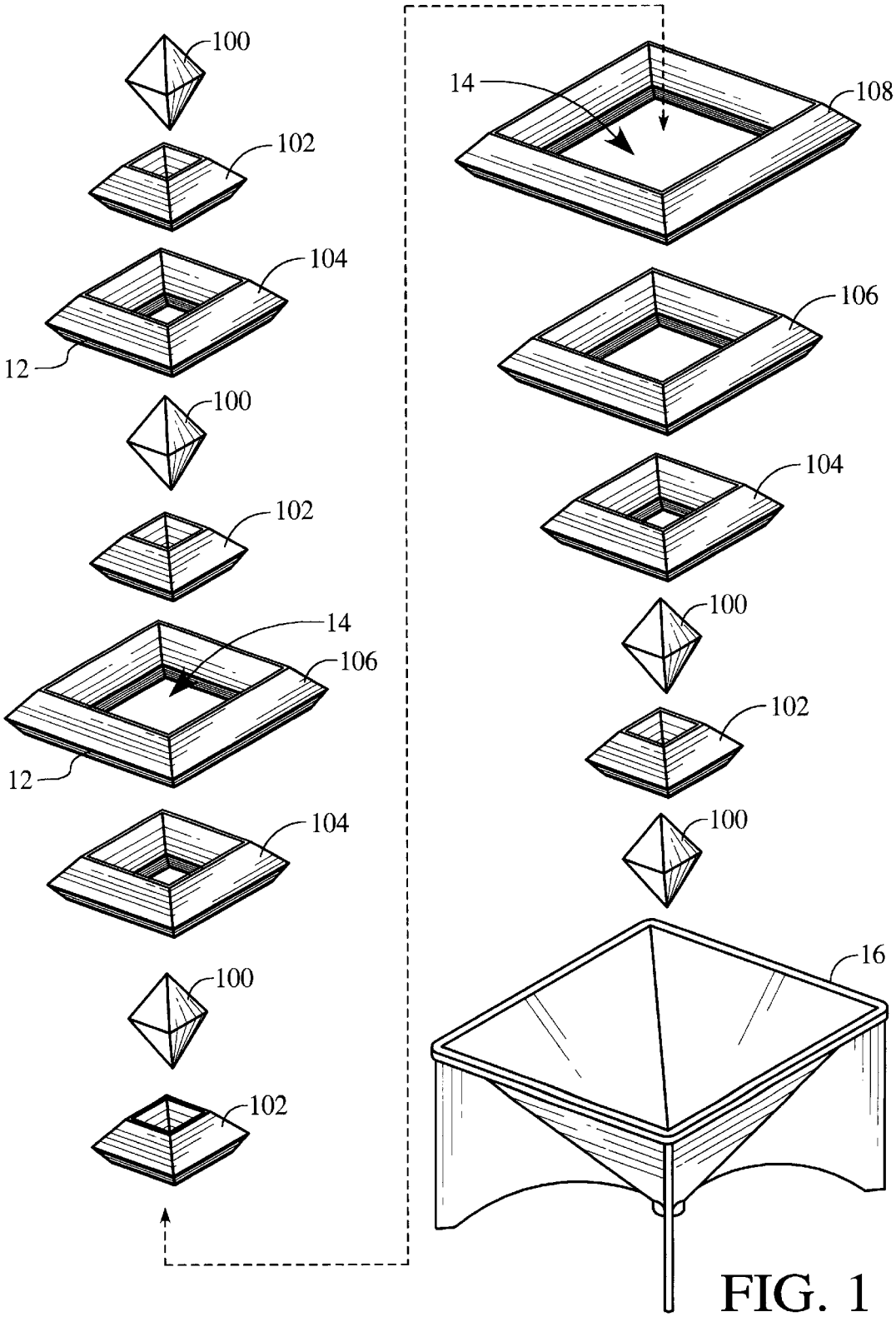
FIG. 1 is an exploded perspective view of the building blocks and pedestal base of the present invention.

The present invention comprises a plurality of polygonal nesting blocks 10 and cap blocks 100. Each nesting block 10 is formed with a polygonal perimeter member 12 that encloses an open central area 14. In the preferred embodiment, each polygonal perimeter member 12 has a diamond-shaped cross section, and four sides so that a square central area 14 is defined. The cap blocks 100 are received in the central area 14 of the smallest nesting block. The cap blocks 100 are equilateral octahedrons in the preferred embodiment.

Figure 1A:
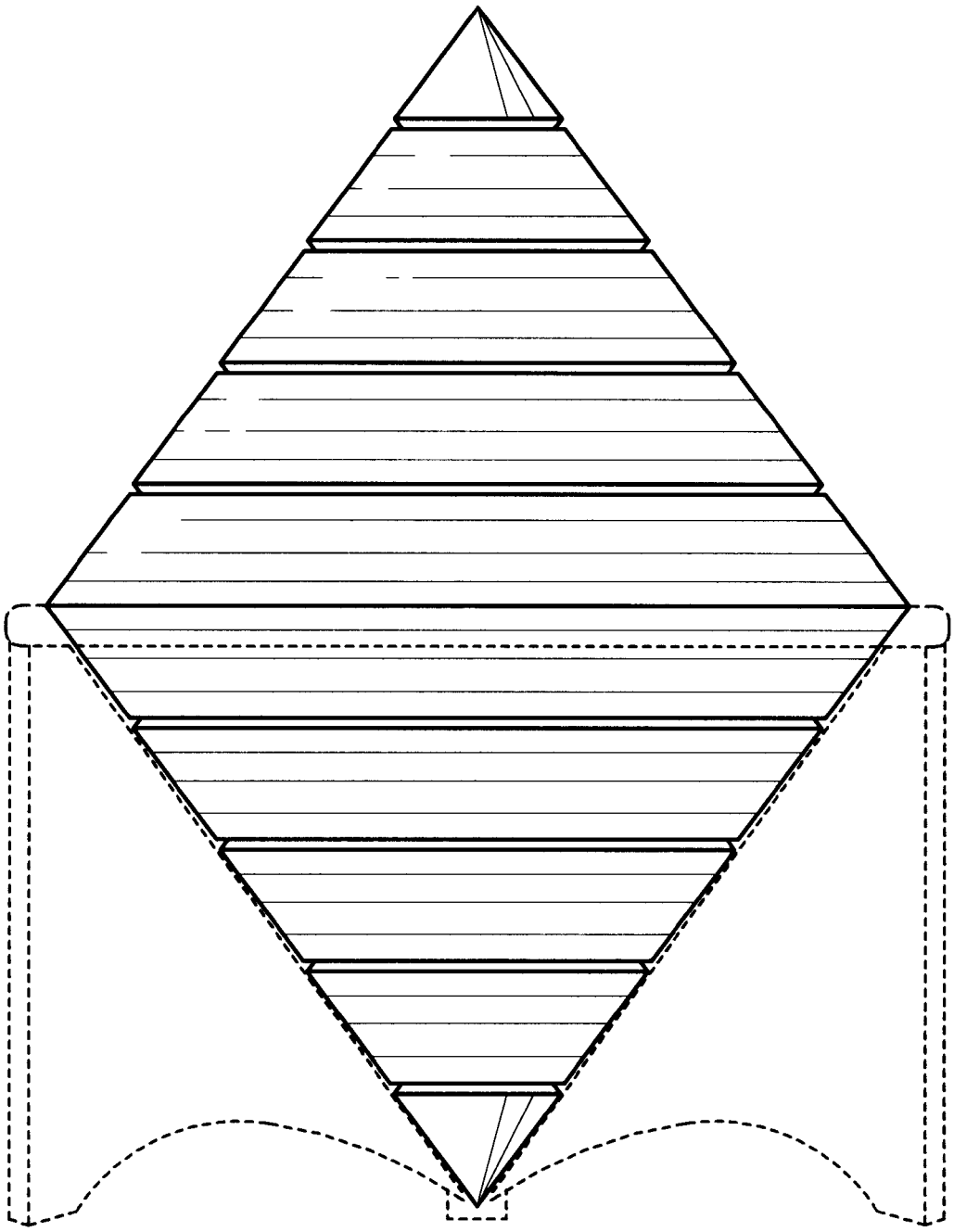
FIG. 1A shows the building blocks nested in the pedestal base.
Figure 2:
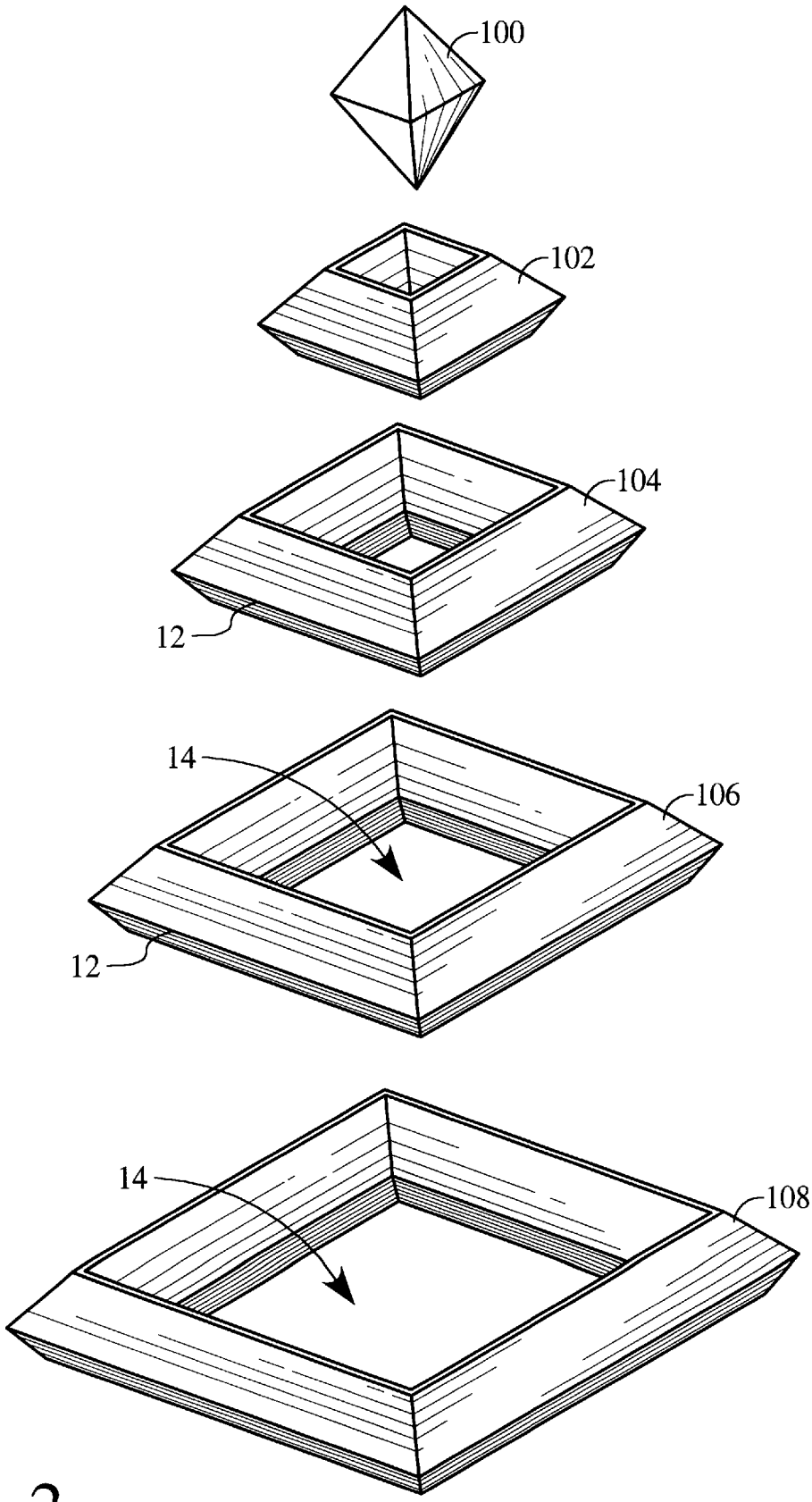
FIG. 2 is a perspective view of each of the building blocks in a set of the present invention.
Figure 3:
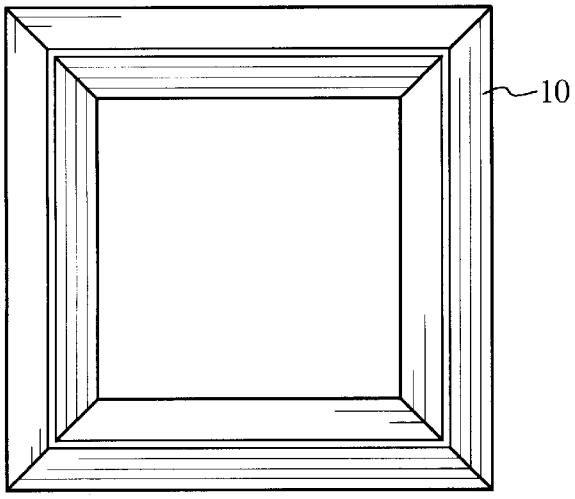
FIG. 3 is a top view of an individual building block.
Figure 4:
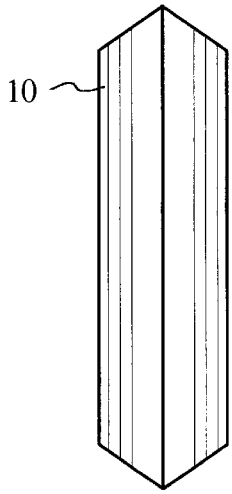
FIG. 4 is a side view of an individual building block.

Referring now chiefly to FIGS. 1 and 2, the blocks 10 are grouped in sets. Each set comprises a plurality of the nesting blocks 10 in varying sizes, and a plurality of cap blocks 100. The number of blocks 10 and cap blocks 100 in each set can vary according to the desires of the user. The number of blocks in the set is a function of the complexity of the designs that the user wants to build. The structure of the block sets is most easily visualized with reference to FIGS. 1 and 1A, which show the set of blocks 10, 100 and a pedestal base 16 to receive the nested blocks 10, 100.

The pedestal base 16 is preferably clear so that the blocks can be seen while they are in the pedestal base 16. An interior of the base 16 has a conformation that is the same as that of the geometric shape being formed by the blocks. In the preferred embodiment, the geometric shape is an octahedron.

Each set begins with a nesting A block 102 coupled with a cap block 100. Upper outer surfaces of each block are parallel to corresponding lower inner surfaces, so that the blocks align when nested. Further, the surface area of one half of the cap block 100 is equal to the surface area of an inner surface of the nesting A block 102, so that the cap block 100 is received in the inner portion of the nesting A block 102.

In the preferred embodiment, at least one nesting B block 104, at least one nesting C block 106, and at least one nesting D block 108 are also provided. As with the nesting A block 102 and the cap block 100, the nesting B block 104 receives the nesting A block 102. That is, the surface area of an upper outer surface of nesting A block 102 is equal to the surface area of an inner surface of the nesting B block 104, so that the outer portion of the nesting A block 102 is received in an inner portion of the nesting B block 104. With the cap block 100 and the four nesting blocks 102–108 in place, the unit forms the shell of a lower half of a octahedron, or an inverted rectangular pyramid.

In the preferred embodiment, the interior of the set is filled so that a solid polygon is formed. A second cap block 100 is placed in the upper inner section of the first nesting A block 102. A second nesting A block 102 is then placed in the upper inner section of the nesting B block 104, and a second nesting B block 104 is placed in the upper inner section of the nesting C block 106. A third cap block is placed in the upper inner section of the second nesting A block 102, and the lower half of the octahedron is filled. At this point, the upper surface of the set is uneven, with the upper surfaces of the nesting D block 108, the second nesting B block 104, and the third cap block 100 exposed. Those exposed upper surfaces do however lie in a single plane.

To complete the top half of the solid octahedron, the nesting process is simply reversed. A second nesting C block 106 is placed in the nesting D block 108, and a second nesting A block 102 is placed in the second nesting B block 104. Next, a third nesting C block 106 is placed in the second nesting C block 106, and a fourth cap block 100 is placed in the third nesting A block 102. The octahedron shape is completed by placing a fourth nesting A block 102 in the third nesting B block 104, and a fifth cap block 100 in the fourth nesting A block 102. The octahedron formed in this manner is solid, and has planar surfaces (neglecting the seams between the multiple nesting blocks) defining each of its sides. This is the preferred set of building blocks of the present invention.

The blocks in a set will typically be color coded. The color coding of the blocks is instrumental to the product's use in education for support in the development of critical thinking skills and complex pattern recognition. It is envisioned that the blocks will be provided with at least three color coding schemes:

Style #1: In this style, each nesting block is a particular color. For instance, cap block 100 is white, nesting A block 102 is green, nesting B block 104 is yellow, nesting C block 106 is blue, and nesting D block 108 is red.

Style #2: In style # 2, either the top or the bottom surface of the blocks will be color coded as in style # 1. However, the remaining surface of the blocks will be a single color such as black. This would allow construction of an octahedron that is multi-colored on one half, and all one color on the other half. Alternatively, the octahedron could have layers of the single color alternating with layers of the multi-colored blocks.

Style #3: This style would provide an entire set of blocks that was all one color.

The multi-colored coding scheme creates a new learning environment for verbal instruction based on both size and color versus standard systems utilizing size alone or color alone. Pattern recognition skills and design modeling replication can be promoted through the visual stimulus of coded coloring. Additionally, development of listening skills, memory retention, and association skills can be enhanced through oral instruction for the user to follow design sequencing steps (color followed by size, or size followed by color, or color patterning through repetition of sequences).

To expand the possibilities of the types of structure and designs that can be built with the building blocks of the present invention, it is envisioned that various linking elements and building platforms will be provided with the sets of nesting blocks. The linking elements and building platforms provide means to join substructures together and to create more varied designs with the nesting blocks. Some examples of linking elements and building platforms are illustrated in FIGS. 5–11.

Figure 5:
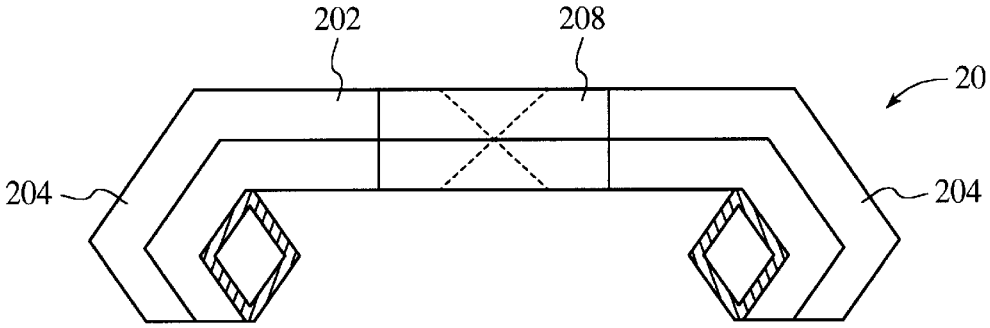
FIG. 5 is a side view of a first linking element.
Figure 6:
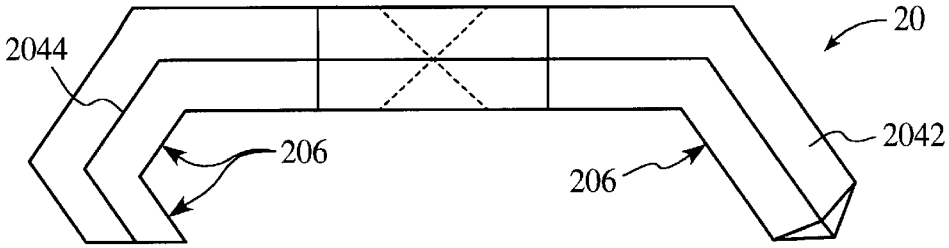
FIG. 6 is a side view of a second linking element.

FIGS. 5–6 show side view of a first linking arm 20. The linking arm 20 comprises a central extending body 202, and a pair of connecting ends 204. Each of the connecting ends 204 may be either an open end 2042 or a closed end 2044. The open connecting end 2042 has a single arm portion extending from the central body 202 at a 45° angle. The closed connecting end 2044 includes a terminal end angled at 45° to the arm portion.

A connecting surface 206 of the open connecting end 2042 therefore includes a single angle corresponding to the angle of the upper surface of the nesting blocks 10 relative to vertical. The connecting surface 206 of the closed connecting end 2044 has two angles, a first angle corresponding to the angle of the upper surface of the nesting blocks 10 relative to perpendicular, and a second angle corresponding to the angle of the lower surface of the nesting blocks 10 relative to perpendicular. The linking arms are thus able to join two structures, either nesting blocks 10 or pedestal bases 16, together at a fixed distance.

Figure 7:
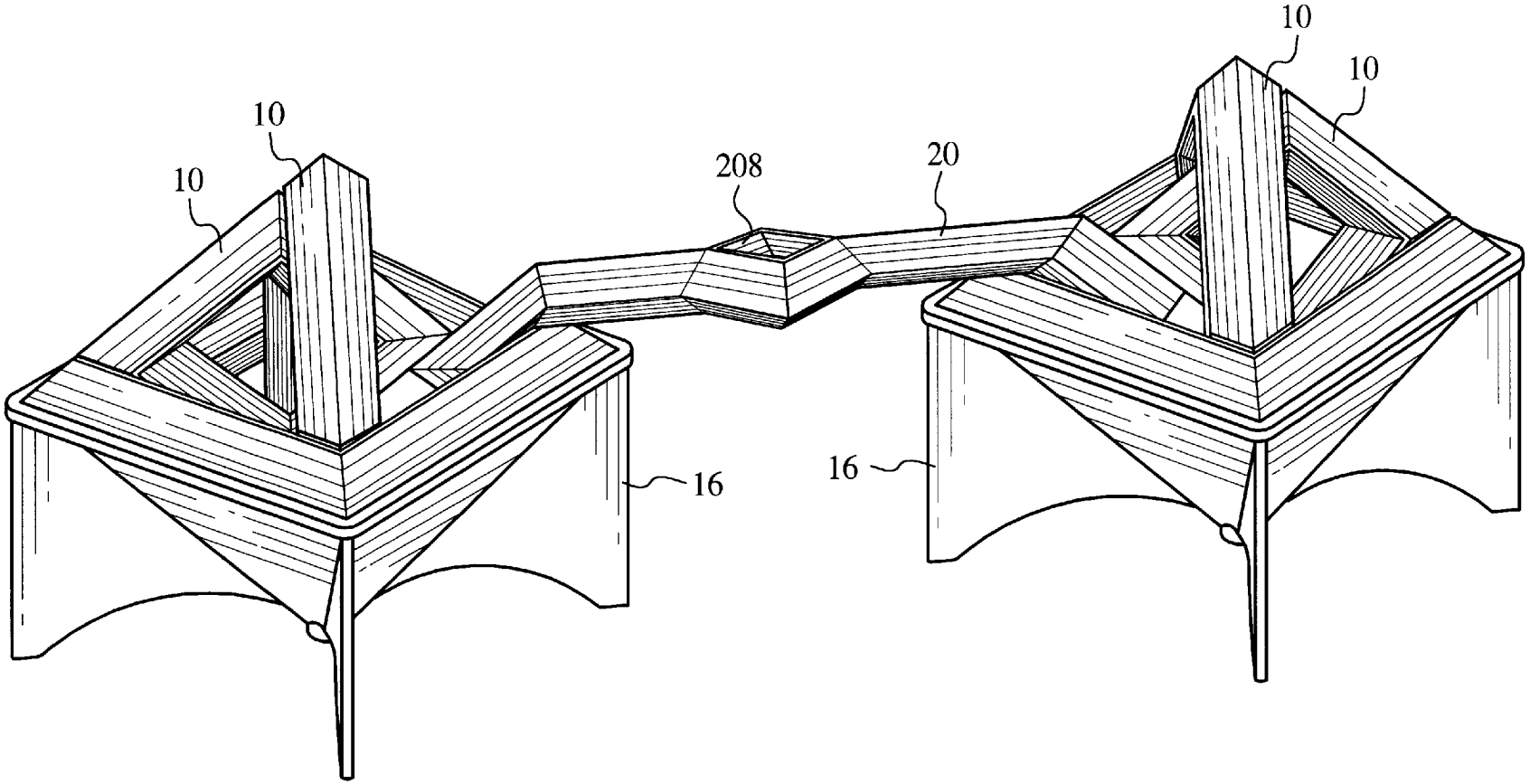
FIG. 7 is a perspective view of a structure including two pedestal bases with block designs contained therein joined by a linking element.

FIG. 7 shows a structure created with two of the pedestal bases 16 joined by a linking arm 20 with two open connecting ends 2042. The structure formed in the pedestal bases 16 comprises a plurality of the nesting blocks 10. As is evident from FIG. 7, the unique geometry of the nesting blocks 10 allows them to be stacked together in many different orientations.

In addition, FIG. 7 illustrates an integral building platform 208 that can be included in the linking arm 20. The platform 208 in the preferred embodiment has the same configuration as one of the nesting blocks 10, so that it can readily receive other nesting blocks 10 or linking arms 20. Using the building platform 208, a user of the present invention can, in addition to joining two structures with the linking arm 20, build yet another structure, or series of structures, extending from the building platform 208.

Figure 8:
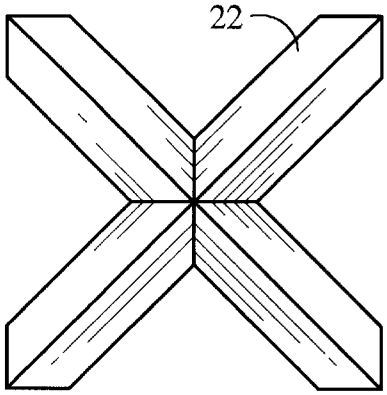
FIG. 8 is a top view of a quad platform.
Figure 9:
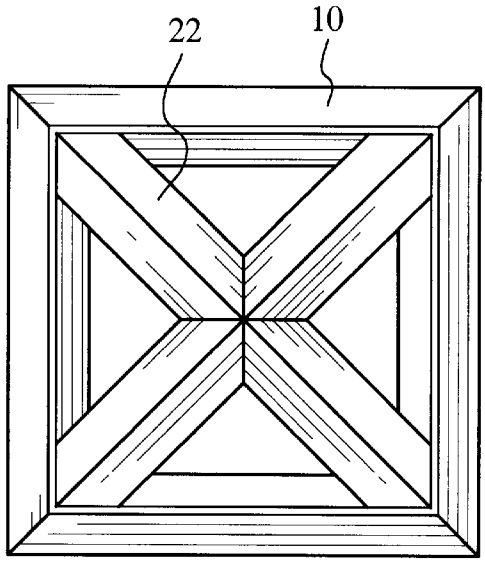
FIG. 9 is a top view of a quad platform installed in a building block.

FIG. 8 shows another modifying element, a quad platform 22. The quad platform 22 is received in an interior of one of the nesting blocks 10 as illustrated in FIG. 9. The arms of the quad platform 22 correspond to the diagonals of the interior of the nesting block 10. A top surface of the quad platform 22 has the same angled profile as the top surface of the nesting blocks 10 so that it too accommodates other nesting blocks and linking elements. The quad platform 22 provides the user with further variations for building structures. If desired, a nesting block 10 with an integral quad platform 22 can be manufactured, so that the block includes the interior quad platform 22 along with the nesting block 10.

Figure 10:
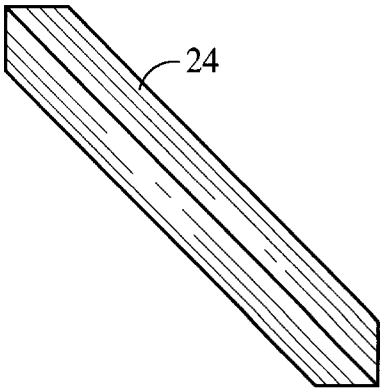
FIG. 10 is a top view of a diagonal platform.
Figure 11:
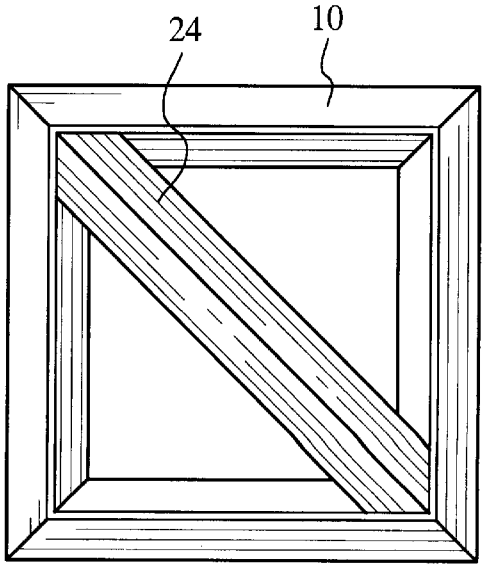
FIG. 11 is a top view of a diagonal platform installed in a building block.

FIG. 10 illustrates yet another modifying element, a diagonal platform 24. With a structure analogous to the quad platform 22, the diagonal platform 24 is received in the interior of a nesting block 10. The diagonal platform 24 lies along a single diagonal of the interior of the nesting block 10 as shown in FIG. 11. As with the quad platform 22, a top surface of the diagonal platform 24 has the same angled profile as the top surface of the nesting blocks 10. Again, if desired, the diagonal platform 24 can be constructed so as to be integral to the nesting block 10.

Figure 12:
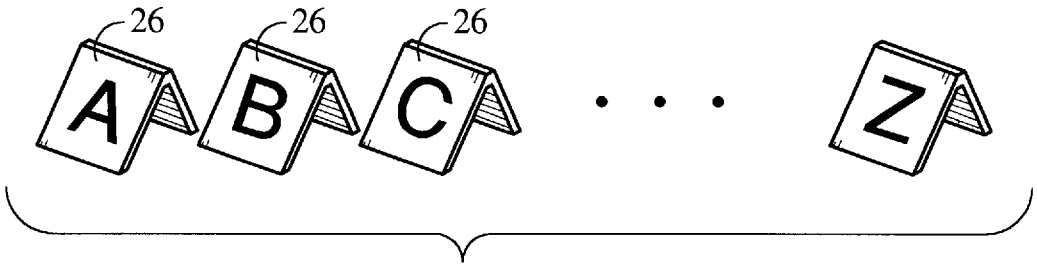
FIG. 12 shows lettered markers adapted to be mounted on a building block.
Figure 13:
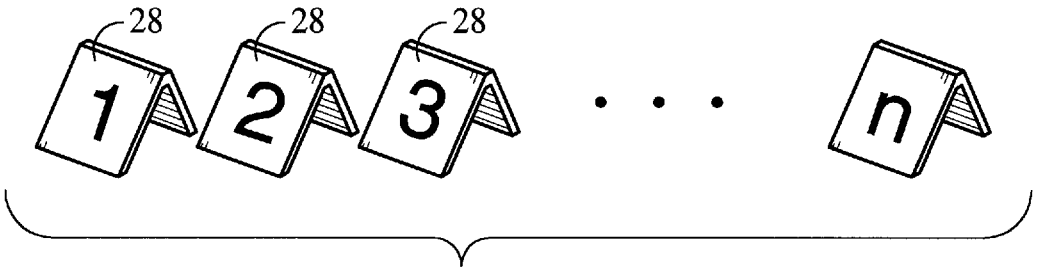
FIG. 13 shows numbered markers adapted to be mounted on a building block.
Figure 14:
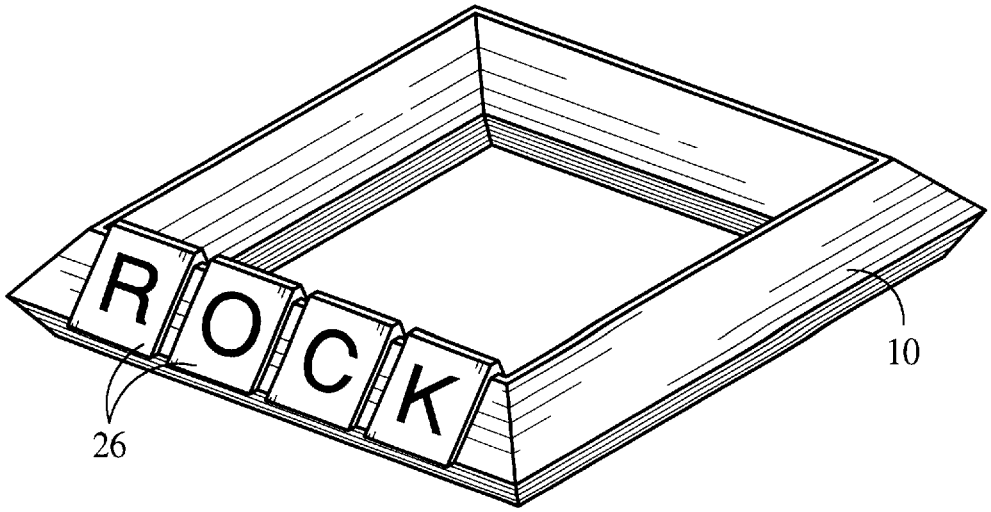
FIG. 14 shows lettered markers mounted on a block to spell a word.

FIGS. 12–14 illustrate yet another function of the present invention. FIG. 12 shows a plurality of placards 26 with letter imprinted on them. FIG. 13 depicts a plurality of placards 28 with numeric characters imprinted on them. FIG. 14 shows the placards 26, 28 placed on the top surface of a nesting block 10 for display. In this manner, a user of the blocks can also be given instruction on language and math skills.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A set of building blocks comprising:

a plurality of polygonal nesting blocks and at least one cap block; wherein each one of said nesting blocks is formed with a polygonal perimeter member with a diamond-shaped cross section, said perimeter member defines an open central area, and said nesting blocks are in varying sizes so that each nesting block receives a succeeding nesting block in an inner portion of a preceding nesting block, and a terminal nesting block receives said cap block in an inner portion of said terminal nesting block.

2. The building blocks of claim 1 wherein:

said perimeter member is a square.

3. The building blocks of claim 1 wherein:

said cap block is an equilateral octahedron.

4. The building blocks of claim 1 wherein:

at least four nesting blocks are included in said set of building blocks.

5. The building blocks of claim 1 wherein:

said set includes a pedestal base, an interior of said base has a conformation that is the same as that of the geometric shape formed when said nesting blocks are placed in a nested configuration.

6. The building blocks of claim 1 wherein:

upper surfaces of each nesting block and said cap block are parallel to corresponding lower surfaces, each said nesting block and said cap block includes inward and outward surfaces, one half of said inward surface is essentially equal in area and conformation to one half of an engaging one of said outward surfaces of a corresponding nested nesting block, so that said outward surfaces of said nesting blocks and said cap block align to form essentially planar outer surfaces when nested.

7. The building blocks of claim 1 wherein:

at least one linking element is included, said linking element joins together at a fixed distance two of said nesting blocks, one of said nesting blocks and a pedestal base, or two of said pedestal bases.

8. The building blocks of claim 7 wherein:

said linking element comprises a central extending body and a pair of connecting ends.

9. The building blocks of claim 8 wherein:

said linking element comprises a building platform in said central extending body, said building platform has a conformation equivalent to that of one of said nesting blocks.

10. The building blocks of claim 8 wherein:

at least one of said connecting ends comprises a single arm portion extending from said central extending body at an angle corresponding to an angle of an upper surface of one of said nesting blocks relative to vertical.

11. The building blocks of claim 8 wherein:

at least one of said connecting ends comprises a single arm portion extending from said central extending body at an angle corresponding to an angle of an upper surface of one of said nesting blocks relative to a lower surface of said one of said nesting blocks, and and a second arm portion extending from said first arm portion at an angle corresponding to an angle of a lower surface of one of said nesting blocks relative to vertical.

12. The building blocks of claim 1 wherein:

at least one building platform is included, said building platform comprises a means to secure said building platform in said open central area of at least one of said nesting blocks, said building platform coinciding with a diagonal of said at least one of said nesting blocks.

13. The building blocks of claim 12 wherein:

said building platform coincides with at least two diagonals of said at least one of said nesting blocks.

14. The building blocks of claim 1 wherein:

each size of said nesting blocks has a specific color so that said nesting blocks are differentiated by their size and by their color.

15. The building blocks of claim 1 wherein:

each of said nesting blocks has a first color on an upper side thereof, and a second color on a lower side thereof.

16. A set of building blocks comprising:

a plurality of polygonal nesting blocks and a plurality of cap blocks, each of said nesting blocks is formed with a polygonal perimeter member that encloses an open central area, said set comprises at least one nesting block of a first, largest size, at least two nesting blocks of a second, smaller size, at least three nesting blocks of a third, still smaller size, at least four nesting blocks of a fourth, smallest size, and at least five cap blocks, set comprises an equilateral octahedron, a lower shell of said equilateral octahedron is formed by positioning a first one of said cap blocks as the point of said shell, placing a first said nesting block of said fourth size on top of said first cap block, then placing a first said nesting block of said third size on top of said first nesting block of said fourth size, then placing a first said nesting block of said second size on top of said first nesting block of said third size, then placing a first said nesting block of said first size on top of said first nesting block of said second size, said shell is then filled by placing a second one of said cap blocks in said central area of said first nesting block of said fourth size, then placing a second said nesting block of said fourth size on top of said second cap block and said first nesting block of said second size, then placing a second nesting block of said third size on top of said second nesting block of said fourth size and said first nesting block of said second size, then placing a third one of said cap blocks on top of said second nesting block of said fourth size, thereby completing a lower half of said octahedron, then filling a top half of said octahedron by placing a third nesting block of said fourth size on top of said third cap block, then placing a second nesting block of said second size on top of said nesting block of said first size and said second nesting block of said third size, then placing a fourth one of said cap blocks on top of said third nesting block of said fourth size and a third nesting block of said third size on top of said second nesting block of said second size, then placing a fourth nesting block of said fourth size on top of said third nesting block of said third size, and finally placing a fifth one of said cap blocks on top of said fourth nesting block of said fourth size, thereby forming a solid equilateral octahedron.

17. The building blocks of claim 16 wherein:

said set includes a pedestal base, an interior of said base receives said lower half of said equilateral octahedron.

18. The building blocks of claim 16 wherein:

at least one linking element is included, said linking element joins together at a fixed distance two of said nesting blocks, one of said nesting blocks and a pedestal base, or two of said pedestal bases.

19. The building blocks of claim 18 wherein:

said linking element comprises a central extending body and a pair of connecting ends.

20. The building blocks of claim 19 wherein:

said linking element comprises a building platform in said central extending body, said building platform has a conformation equivalent to that of one of said nesting blocks.

21. The building blocks of claim 19 wherein:

at least one of said connecting ends comprises a single arm portion extending from said central extending body at an angle corresponding to an angle of an upper surface of one of said nesting blocks relative to vertical.

22. The building blocks of claim 19 wherein:

at least one of said connecting ends comprises a single arm portion extending from said central extending body at an angle corresponding to an angle of an upper surface of one of said nesting blocks relative to a lower surface of said one of said nesting blocks, and and a second arm portion extending from said first arm portion at an angle corresponding to an angle of a lower surface of one of said nesting blocks relative to vertical.

23. The building blocks of claim 16 wherein:

at least one building platform is included, said building platform comprises a means to secure said building platform in said open central area of at least one of said nesting blocks, said building platform coinciding with a diagonal of said at least one of said nesting blocks.

24. The building blocks of claim 23 wherein:

said building platform coincides with at least two diagonals of said at least one of said nesting blocks.

25. The building blocks of claim 16 wherein:

each size of said nesting blocks has a specific color so that said nesting blocks are differentiated by their size and by their color.

26. The building blocks of claim 16 wherein:

each of said nesting blocks has a first color on an upper side thereof, and a second color on a lower side thereof.

27. A set of building blocks comprising:

a plurality of polygonal nesting blocks and at least one cap block; wherein each one of said nesting blocks is formed with a polygonal perimeter member that encloses an open central area, and said nesting blocks are in varying sizes so that each nesting block receives a succeeding nesting block in an inner portion of a preceding nesting block, and a terminal nesting block receives said cap block in an inner portion of said terminal nesting block, upper surfaces of each nesting block and said cap block are parallel to corresponding lower surfaces, each said nesting block and said cap block includes inward and outward surfaces, so that said outward surfaces of said nesting blocks and said cap block align to form essentially planar outer surfaces when nested.

28. A set of building blocks comprising:

a plurality of polygonal nesting blocks and at least one cap block; wherein each one of said nesting blocks is formed with a polygonal perimeter member that encloses an open central area, and said nesting blocks are in varying sizes so that each nesting block receives a succeeding nesting block in an inner portion of a preceding nesting block, and a terminal nesting block receives said cap block in an inner portion of said terminal nesting block, and at least one linking element is included, said linking element joins together at a fixed distance one of a, two of said nesting blocks, b one of said nesting blocks and a pedestal base, and c two of said pedestal bases.

29. The building blocks of claim 28 wherein:

said linking element comprises a central extending body and a pair of connecting ends.

30. The building blocks of claim 29 wherein:

said linking element comprises a building platform in said central extending body, said building platform has a conformation equivalent to that of one of said nesting blocks.

31. The building blocks of claim 29 wherein:

at least one of said connecting ends comprises a single arm portion extending from said central extending body at an angle corresponding to an angle of an upper surface of one of said nesting blocks relative to vertical.

32. The building blocks of claim 29 wherein:

at least one of said connecting ends comprises a single arm portion extending from said central extending body at an angle corresponding to an angle of an upper surface of one of said nesting blocks relative to a lower surface of said one of said nesting blocks, and and a second arm portion extending from said first arm portion at an angle corresponding to an angle of a lower surface of one of said nesting blocks relative to vertical.

33. A set of building blocks comprising:

a plurality of polygonal nesting blocks and at least one cap block; wherein each one of said nesting blocks is formed with a polygonal perimeter member that encloses an open central area, and said nesting blocks are in varying sizes so that each nesting block receives a succeeding nesting block in an inner portion of a preceding nesting block, and a terminal nesting block receives said cap block in an inner portion of said terminal nesting block, and at least one building platform is included, said building platform comprises a means to secure said building platform in said open central area of at least one of said nesting blocks, said building platform coinciding with a diagonal of said at least one of said nesting blocks.

34. The building blocks of claim 33 wherein:

said building platform coincides with at least two diagonals of said at least one of said nesting blocks.

* * * * *